US008844763B1

(12) United States Patent
Momirov et al.

(10) Patent No.: US 8,844,763 B1
(45) Date of Patent: Sep. 30, 2014

(54) KNIT COZY SYSTEM

(76) Inventors: Emilia Momirov, Spring Hill, FL (US); Guy W. Michaud, Spring Hill, FL (US)

( * ) Notice: Subject to any disclaimer, the term of this patent is extended or adjusted under 35 U.S.C. 154(b) by 0 days.

(21) Appl. No.: 13/592,848

(22) Filed: Aug. 23, 2012

(51) Int. Cl.
*B65D 81/38* (2006.01)

(52) U.S. Cl.
USPC ..... 220/739; 220/903; 383/72; 206/524.1; 215/395; 215/11.6; 215/386; 66/170; 150/154

(58) Field of Classification Search
CPC .... B65D 81/38; B65D 81/3876; A47G 23/00; A47G 23/03
USPC ..... 220/739, 903; 215/395, 11.6, 386; 383/72; 206/524.1; 66/170; 150/154
See application file for complete search history.

(56) References Cited

U.S. PATENT DOCUMENTS

| | | | | |
|---|---|---|---|---|
| 2,610,757 | A * | 9/1952 | Irvine | 220/592.24 |
| 4,514,995 | A * | 5/1985 | Curtis et al. | 66/170 |
| 5,158,193 | A * | 10/1992 | Chen | 215/386 |
| D544,312 | S * | 6/2007 | Dill-Schmidt et al. | D7/624.3 |
| 2007/0095843 | A1 * | 5/2007 | Wu | 220/628 |
| 2008/0226204 | A1 * | 9/2008 | Sabounjian et al. | 383/74 |

* cited by examiner

*Primary Examiner* — Elizabeth Volz

(57) ABSTRACT

A fabric tube has a closed bottom and an open top. The closed bottom forms a semicircular section when unstretched. The tube has a cylindrical section between the open top and the semicircular section. The cylindrical section has a common circumference when unstretched. A tunnel is formed in the open top of the tube. The tunnel is formed by a folded back edge adjacent to the open upper end of the tube. An elastic thread joins the folded back edge of the tube to a portion of the tube there beneath. A cord has a central section within the tunnel. The cord has two free ends extending through end openings to exterior of the tunnel.

1 Claim, 2 Drawing Sheets

KNIT COZY SYSTEM

BACKGROUND OF THE INVENTION

Field of the Invention

The present invention relates to a knit cozy system and more particularly pertains to receiving and supporting a bottle of a beverage to be drunk, the receiving and supporting being done in a safe, convenient, eye-appealing and economical manner.

SUMMARY OF THE INVENTION

In view of the disadvantages inherent in the known types of knit systems of known designs and configurations now present in the prior art, the present invention provides an improved knit cozy system. As such, the general purpose of the present invention, which will be described subsequently in greater detail, is to provide a new and improved knit cozy system and method which has all the advantages of the prior art and none of the disadvantages.

To attain this, the present invention essentially comprises a knit cozy system. A fabric tube has a closed bottom and an open top. The closed bottom forms a semicircular section when unstretched. The tube has a cylindrical section between the open top and the semicircular section. The cylindrical section has a common circumference when unstretched. A tunnel is formed in the open top of the tube. The tunnel is formed by a folded back edge adjacent to the open upper end of the tube. An elastic thread joins the folded back edge of the tube to a portion of the tube there beneath. A cord has a central section within the tunnel. The cord has two free ends extending through end openings to exterior of the tunnel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved knit cozy system which has all of the advantages of the prior art knit systems of known designs and configurations and none of the disadvantages.

It is another object of the present invention to provide a new and improved knit cozy system which may be easily and efficiently manufactured and marketed.

It is further object of the present invention to provide a new and improved knit cozy system which is of durable and reliable constructions.

An even further object of the present invention is to provide a new and improved knit cozy system which is susceptible of a low cost of manufacture with regard to both materials and labor, and which accordingly is then susceptible of low prices of sale to the consuming public, thereby making such knit cozy system economically available to the buying public.

Lastly, it is an object of the present invention to provide a new and improved knit cozy system for receiving and supporting a bottle of a beverage to be drunk, the receiving and supporting being done in a safe, convenient, eye-appealing and economical manner.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
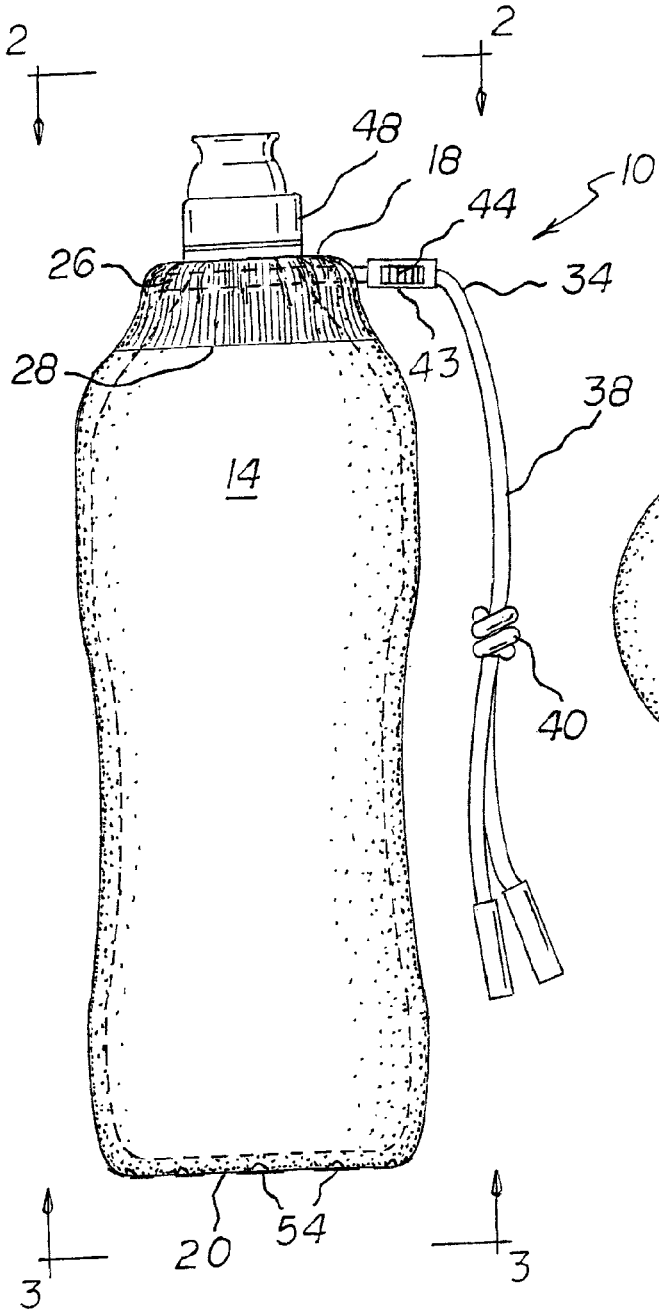
FIG. 1 is a front elevational view of a knit cozy system constructed in accordance with the principles of the present invention.
Figure 2:
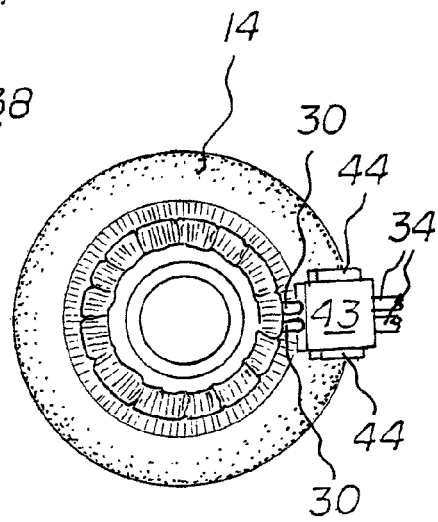
FIG. 2 is a plan view of the knit cozy system taken along line 2-2 of FIG. 1.
Figure 3:
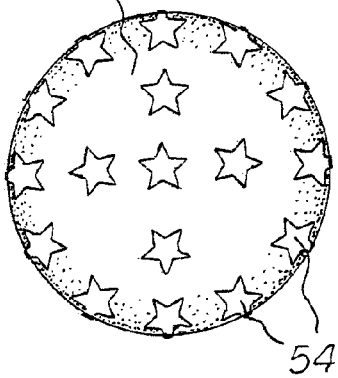
FIG. 3 is a bottom view of the knit cozy system taken along line 3-3 of FIG. 1.
Figure 4:
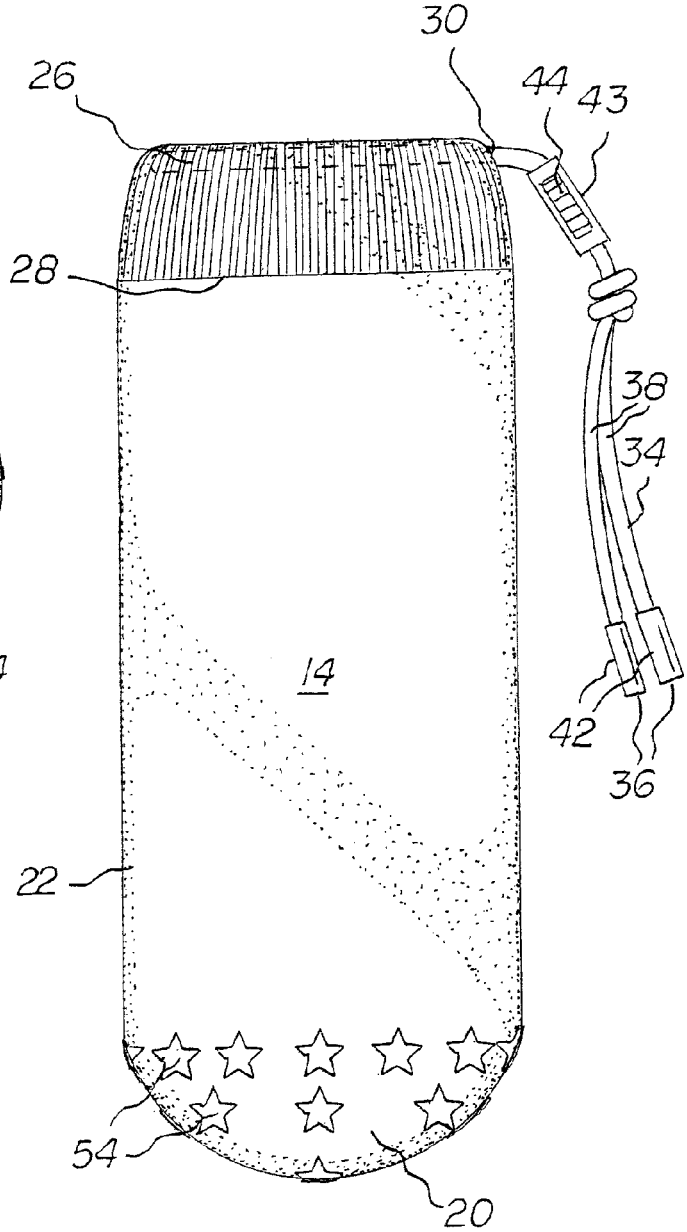
FIG. 4 is a front elevational view similar to FIG. 1 but with the supported bottle removed.

With reference now to the drawings, and in particular to FIG. 1 thereof, the preferred embodiment of the new and improved knit cozy system embodying the principles and concepts of the present invention and generally designated by the reference numeral 10 will be described.

The present invention, the knit cozy system 10 is comprised of a plurality of components. Such components in their broadest context include a fabric tube, a tunnel, and a cord. Such components are individually configured and correlated with respect to each other so as to attain the desired objective.

First provided is a tube 14. The tube is fabricated of a fabric. The fabric has an interior surface. The fabric has an exterior surface. The tube has a closed bottom 16. The tube has an open top 18. The bottom and top are separated by an overall axial length. The overall axial length is 9.5 inches plus or minus 10 percent when unstretched. The closed bottom forms a semicircular section 20 when unstretched. The tube has a cylindrical section 22. The cylindrical section is provided between the open top and the semicircular section. The cylindrical section has a common circumference of 7 inches plus or minus 10 percent when unstretched. The cylindrical section has an axial length of 8 inches plus or minus 10 percent when unstretched. The circumference of the cylindrical section of the tube is between 80 and 85 percent of the overall axial length of the tube.

The fabric is knit from yarn. The yarn is chosen from the class of yarns. The class of yarns includes cotton and wool and polyester and blends thereof. The unstretched cylindrical section of the tube is adapted to expand in circumference up to twice the unstretched circumference.

A tunnel 26 is provided. The tunnel is formed in the open top of the tube. The tunnel is formed by a folded back edge adjacent to the open upper end of the tube. An elastic thread 28 is provided. The thread joins the folded back edge of the tube to a portion of the tube there beneath. The tunnel has end openings 30. The end openings are provided adjacent to each other.

A cord 34 is provided next. The cord has a central section. The central section is provided within the tunnel. The cord has two free ends 36. The free ends extend through the end openings to exterior of the tunnel. The cord has elongated sections 38. The elongated sections are provided between the free ends and the end openings of the tunnel. A knot 40 is provided. The knot is provided in the elongated sections. Elastomeric tips 42 are provided. The elastomeric tips are provided at the free ends of the cord. A slider 43 is provided. The slider is slidably mounted on the elongated sections of the cord between the knot and the end openings of the tunnel. The slider has undulating faces 44. The faces are adapted to be grasped by a user. In this manner the slider is pushed. Further in this manner the size of the open top is varied. The slider is adapted to remain by friction at the location it was last pushed by a user.

Further provided is a bottle 48. The bottle contains a beverage to be drunk. The bottle has a contoured exterior surface. The exterior surface has regions of reduced circumference and regions of increased circumference. The bottle has a flat horizontal bottom 50. The bottle is positioned within the tube. Entry and removal of the bottle is through the open top end. The interior and exterior surfaces of the tube are adapted to conform to the shape of the exterior surface of the bottle.

Provided last is a plurality of elastomeric components 54. The elastomeric components are adhesively secured to the exterior surface of the semicircular section. In this manner slippage of the tube and bottle on a recipient surface is abated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A knit cozy system (10) for receiving and supporting a bottle of a beverage to be drunk, the receiving and supporting being done in a safe, convenient, eye-appealing and economical manner, the system comprising, in combination:

a tube (14) fabricated of a fabric with an interior surface and an exterior surface, the tube having a closed bottom (16) and an open top (18) separated by an overall axial length when unstretched of 9.5 inches plus or minus 10 percent, the closed bottom forming a semicircular section (20) when unstretched, the tube having a cylindrical section (22) between the open top and the semicircular section, the cylindrical section having a common cross sectional configuration and a common circumference when unstretched of 7 inches plus or minus 10 percent, the cylindrical section having an axial length when unstretched of 8 inches plus or minus 10 percent, the circumference of the cylindrical section of the tube being between 80 and 85 percent of the overall axial length of the tube;

the fabric being knit from yarn, the yarn being chosen from the class of yarns including cotton and wool and polyester and blends thereof, the unstretched cylindrical section of the tube adapted to expand in circumference up to twice the unstretched circumference;

a tunnel (26) formed in the open top of the tube, the tunnel formed by a folded back edge adjacent to the open upper end of the tube, an elastic thread (28) joining the folded back edge of the tube to a portion of the tube there beneath, the tunnel having end openings (30) adjacent to each other;

a cord (34) having a central section within the tunnel and two free ends (36) extending through end openings to exterior of the tunnel, the cord having elongated sections (38) between the free ends and the end openings of the tunnel, a knot (40) in the elongated sections, elastomeric tips (42) at the free ends of the cord, a slider (43) slidably mounted on the elongated sections of the cord between the knot and the end openings of the tunnel, the slider having undulating faces (44) adapted to be grasped by a user to push the slider to vary the size of the open top, the slider adapted to remain by friction at the location it was last pushed by a user;

a bottle (48) containing a beverage to be drunk, the bottle having a contoured exterior surface with regions of reduced circumference and regions of increased circumference, the bottle having a flat horizontal bottom (50), the bottle positioned within the tube with entry and removal of the bottle being through the open top end, the interior and exterior surfaces of the tube adapted to conform to the shape of the exterior surface of the bottle; and a plurality of elastomeric components (54) adhesively secured at spaced locations to the exterior surface of the knit, closed bottom to expand and contract dependent on the size of the bottle and thereby to abate slippage of the tube and bottle on a recipient surface.

* * * * *